US009848675B2

(12) United States Patent
Le Goallec

(10) Patent No.: US 9,848,675 B2
(45) Date of Patent: Dec. 26, 2017

(54) APPARATUS FOR POSITIONING CLEATS ON CYCLIST SHOES

(71) Applicant: 2 FLG, Saint-Malo (FR)

(72) Inventor: Michel Le Goallec, Saint Pere Marc En Poulet (FR)

(73) Assignee: 2 FLG, Saint-Malo (FR)

( * ) Notice: Subject to any disclaimer, the term of this patent is extended or adjusted under 35 U.S.C. 154(b) by 102 days.

(21) Appl. No.: 15/102,158

(22) PCT Filed: Sep. 11, 2014

(86) PCT No.: PCT/EP2014/069430
§ 371 (c)(1),
(2) Date: Jun. 6, 2016

(87) PCT Pub. No.: WO2015/036502
PCT Pub. Date: Mar. 19, 2015

(65) Prior Publication Data

US 2016/0309847 A1 Oct. 27, 2016

(30) Foreign Application Priority Data

Sep. 13, 2013 (FR) ..... 13 58862

(51) Int. Cl.
*A43B 5/14* (2006.01)
*A43D 5/02* (2006.01)
(Continued)

(52) U.S. Cl.
CPC ..... *A43D 5/02* (2013.01); *A43B 5/14* (2013.01); *A43C 15/161* (2013.01); *A43D 1/08* (2013.01); *A43D 3/1433* (2013.01); *A43D 5/00* (2013.01)

(58) Field of Classification Search
CPC ..... A43B 5/14; A43C 15/161; A43D 5/00; A43D 5/02; A43D 1/08
(Continued)

(56) References Cited

U.S. PATENT DOCUMENTS 2,011,437 A * 8/1935 Crocella ..... A43D 5/02 12/123
4,807,368 A 2/1989 Beyl
(Continued)

FOREIGN PATENT DOCUMENTS

EP 0876774 A2 11/1998
FR 2 608 025 A1 6/1988
(Continued)

OTHER PUBLICATIONS

Dec. 16, 2014 Search Report issued in International Patent Application No. PCT/EP2014/069430.
(Continued)

*Primary Examiner* — Marie Bays
(74) *Attorney, Agent, or Firm* — Oliff PLC; R. Brian Drozd

(57) ABSTRACT

An apparatus for effecting the positioning of cleats on shoes includes a baseplate to apply the arch of the foot, a gauge provided with a stop that can slide freely on the baseplate to be in contact with the calcaneum of the foot, and a wall for wedging the front part of the foot at the metatarsophalangeal joint of the big toe. The stop is fixed on a plate that slides parallel to the baseplate and a support for a shoe corresponding to the foot is fixed to the sliding plate. The support includes a stop to be placed in contact with the shoe counter. A marker is secured to the apparatus base and designed to indicate, on the shoe sole, the location for placing the cleat.
(Continued)

Figure 1:
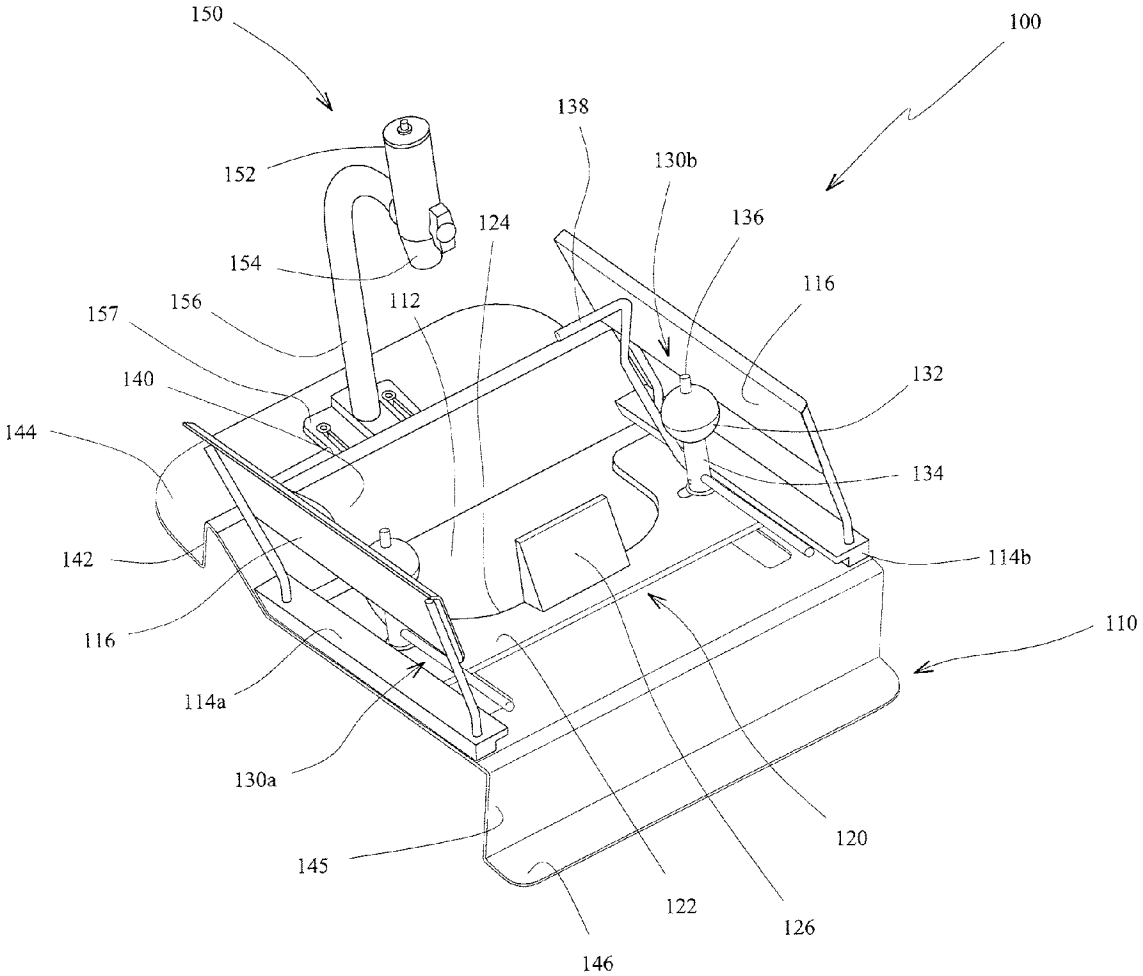

The apparatus enables the distance recorded between the metatarsophalangeal joint of the big toe and calcaneum to be transferred onto the shoe.

15 Claims, 3 Drawing Sheets

(51) Int. Cl.

| | |
|---|---|
| ***A43D 5/00*** | (2006.01) |
| ***A43D 1/08*** | (2006.01) |
| ***A43C 15/16*** | (2006.01) |
| ***A43D 3/14*** | (2006.01) |

(58) Field of Classification Search
USPC ..... 12/122, 123
See application file for complete search history.

(56) References Cited

U.S. PATENT DOCUMENTS

| | | | | |
|---|---|---|---|---|
| 5,946,754 | A | 9/1999 | Baldini | |
| 8,984,759 | B2 * | 3/2015 | Aoki | A43B 5/14 33/3 C |
| 9,089,183 | B2 * | 7/2015 | Aoki | A43B 5/14 |
| 2013/0318805 | A1 * | 12/2013 | Aoki | A43B 5/14 33/515 |
| 2013/0333124 | A1 * | 12/2013 | Okamoto | A43B 5/14 12/123 |

FOREIGN PATENT DOCUMENTS

| | | | |
|---|---|---|---|
| FR | 2 940 020 | A1 | 6/2010 |
| WO | 2005/025974 | A1 | 3/2005 |

OTHER PUBLICATIONS

Dec. 16, 2014 Written Opinion issued in International Patent Application No. PCT/EP2014/069430.

* cited by examiner

APPARATUS FOR POSITIONING CLEATS ON CYCLIST SHOES

The present invention relates to an apparatus for adjusting the position at which cleats are fixed on shoes for cyclists.

Such shoes have in principle on their soles holding means for fixing cleats intended to attach to the pedals of a bicycle. Muscular efficiency and the non-occurrence of musculoskeletal disorders depend on the correct position of the adjustment of these cleats. The various technical and morphological researches demonstrate that the position of the cleat must be adjusted so that the metatarsophalangeal joint of the big toe can be vertically in line with the axis of the pedal, considering the foot placed horizontally on the pedal. The correct position of the foot procures optimum efficiency of the pedaling.

The known solutions for carrying out this adjustment are as follows. There exists an apparatus for adjusting the position of the cleats so that they are placed similarly on the two shoes. The search for this position with respect to the feet of the cyclist is imprecise in placing the foot on the sole of the turned-over shoe. There also exist two appliances, one measuring the size of the foot, the other, a shoe support, having an adjustable finger indicating laterally on the shoe the theoretical location of the metatarsophalangeal joint according to the size of the foot. This solution is imprecise since it is dependent on a manipulation of a shoe and a transfer of a reading. It is fairly complicated to implement.

The applicant has thus sought to design an apparatus that is simple to use, complying with the morphological studies and capable of indicating the theoretical position of the cleat of a cyclist shoe according to the morphology of the foot of the cyclist, with a precision that has not yet been achieved.

To this end, an apparatus is proposed for effecting the positioning of cleats on cyclist shoes, comprising a baseplate to which it is necessary to apply the arch of the foot, a gauge provided with a stop that can slide freely on said baseplate so as to be put in contact with the calcaneum of the foot, and a wall for wedging the front part of the foot, at the metatarsophalangeal joint of the big toe; according to the invention, the stop is fixed on a plate mounted so as to slide parallel to the baseplate, and at least one support for a shoe corresponding to the foot is fixed to said sliding plate, said support comprising a stop suitable for being able to be put into contact with the shoe counter, the apparatus being provided with a marking means secured to the base of the apparatus and designed so as to indicate, on the shoe sole, the location for placing the cleat.

The apparatus thus enables the distance recorded between the metatarsophalangeal joint of the big toe and the calcaneum to be transferred onto the shoe. In operation, the marking means shows on the sole the location of this joint and consequently the exact location for placing the pedal cleat.

The positioning of the cleat on the shoe is carried out in a single operation procuring for the apparatus great precision in measurement and rapidity of implementation.

According to an additional feature of the invention, the stop for the shoe consists of a sphere.

The shoe counter is positioned precisely on the sphere.

Advantageously, the sphere is provided with at least one means for pressing the shoe counter against said sphere in order to position said shoe on the corresponding support with reproducible precision.

The precision of placing of the cleat on the shoe is improved.

According to an additional feature of the invention, the wall for wedging the front part of the foot is an oblique wall that extends the baseplate in an inclined fashion and upwards, forming with said baseplate an obtuse angle of between 130° and 150°.

With the toe resting on this inclined wall, the metatarsophalangeal joint of the big toe is thus positioned precisely vertical in line with the intersection of the baseplate and the wall for front wedging of the foot. This inclined plate guarantees the precision of transfer of the location of the cleat onto the sole of the shoe, in conformity with the research work on the subject.

According to an additional feature of the invention, the support is provided with a rod forming a kind of shoetree for the shoe in order to hold it from the inside, said rod being fixed to the sliding plate, so that the sole of said shoe can be positioned parallel to the baseplate.

According to an additional feature of the invention, the rod comprises a rectilinear part that passes slidingly through a spindle supporting the sphere.

It is then possible to adjust the longitudinal position of the rod in order to fit shoes, with a large range of sizes, on the support. A locking means, such as a knurled screw, locks said rod with respect to translation.

According to an additional feature of the invention, the apparatus comprises a flap that extends upwards on at least one edge of the baseplate in order to orient the shoe laterally so that the cleat that it is to receive can be fixed so that said shoe can be mounted parallel to the cranks of the cycle or taking account of particular podiatry data.

According to an additional feature of the invention, the apparatus comprises two supports and two flaps, disposed on either side of the baseplate, and the sliding plate is hollowed out with a scallop at the location where the foot is placed on the baseplate.

In this way a compact construction of the apparatus is obtained, which is capable of achieving the positioning of the cleats on a pair of shoes.

According to an additional feature of the invention, the support face of the stop for the calcaneum is tangent to the two spheres, in order to make the theoretical position of the calcaneum of the foot correspond to the inside of the shoe.

This feature makes it possible to transfer into the shoe the recorded distance between the metatarsophalangeal joint of the big toe and the calcaneum.

According to an additional feature of the invention, two grooves are produced, one transversely through the sliding plate in order to allow a lateral movement of said or each sphere so that it is held on the middle part of the heel grip of the shoe, and the other longitudinally through the baseplate in order to move the sliding plate forwards or backwards, a gripping handle screwed onto a thread extending the axis of said or each sphere making it possible to release and lock said or each sphere in the chosen position and to lock said sliding plate in position.

According to an additional feature of the invention, the marking means comprises a housing incorporating a light projector, fixed by means of a foot on the base.

According to an additional feature of the invention, the light projector is mounted so as to pivot freely.

It can illuminate either the left shoe or the right shoe.

According to an additional feature of the invention, the light projector incorporates a laser diode capable of projecting at least one luminous line onto the sole of said shoe.

It is then easy to position the cleat on each of the shoes.

According to an additional feature of the invention, the foot of the marking means is provided with a means for adjusting its position on the base of the apparatus.

It is thus possible to compensate in particular for the measurement of the thickness of a sock, to achieve an over-engagement or an under-engagement of the position of the foot on the pedal, preferably of an experienced cyclist.

According to an additional feature of the invention, the foot of the base is fixed to a footing that is mounted for sliding, by means of a runner, on said base, between two supports, and the apparatus is provided with at least one means for measuring the movement of the marking means.

It is then possible to measure a dimension related to the placing of the cleat of the shoe, a measurement that is used for adjusting a parameter of the cycle.

Figure 2:
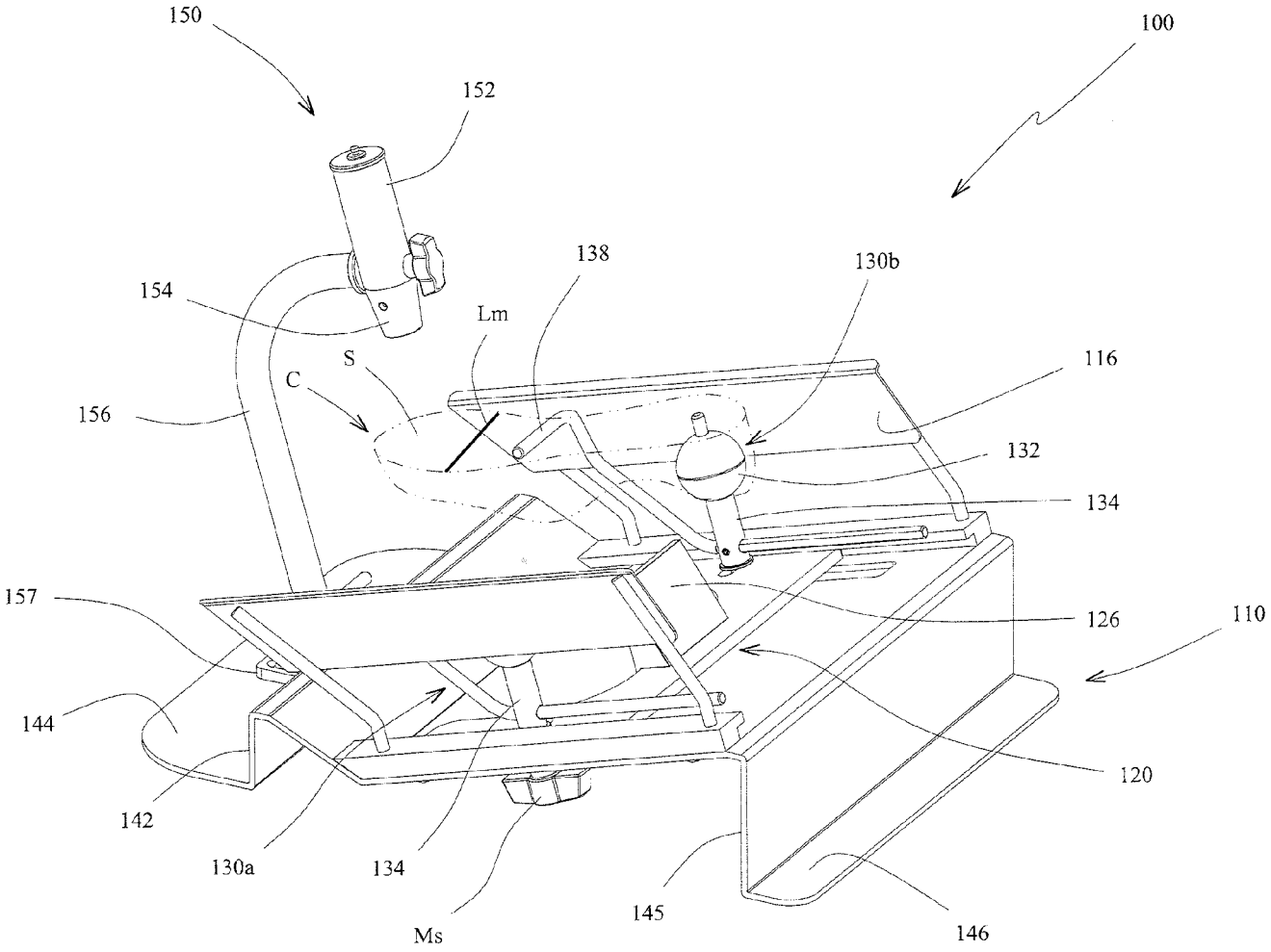
Figure 3:
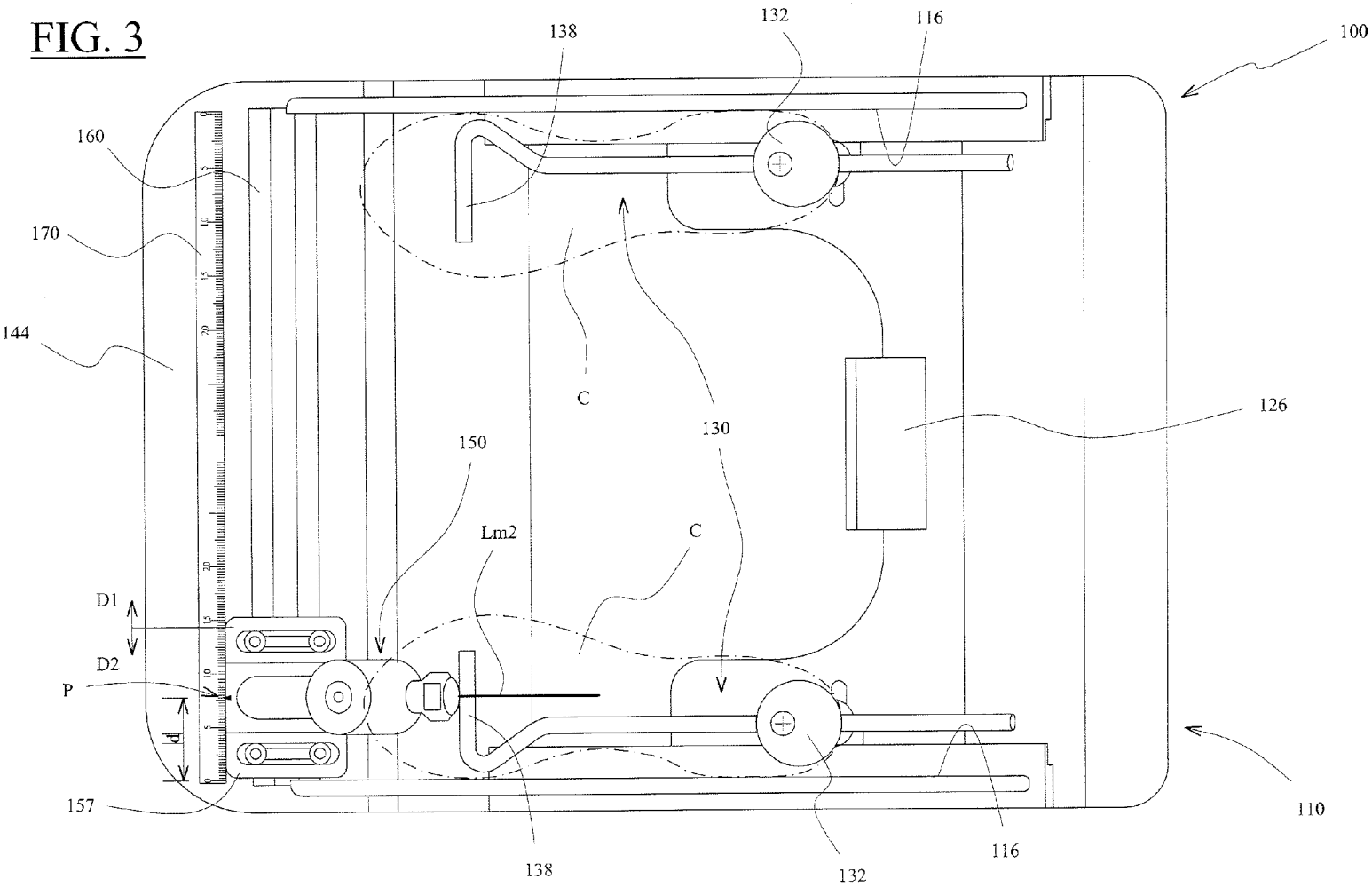

The features of the invention mentioned above, as well as others, will emerge more clearly from a reading of the following description of an example embodiment, said description being given in relation to the accompanying drawings, among which:

FIG. 1 depicts a perspective view of an apparatus for adjusting the position for fixing cleats on cyclist shoes according to the invention, FIG. 2 depicts a perspective view at another angle of such an apparatus on which a shoe is held according to the invention, and FIG. 3 depicts a plan view of a variant embodiment of an apparatus for adjusting the position for fixing cleats on cyclist shoes according to the invention.

The apparatus 100, presented in FIG. 1, is intended to achieve the positioning of cleats on at least one and preferentially a pair of cyclist shoes according to the morphology of each foot of the cyclist. It is presented in its position of use.

It comprises a base 110 intended to rest on the ground and to which there are fixed a gauge 120 mounted for sliding on said base, at least one support 130 and advantageously two supports 130*a*, 130*b*, designed to receive respectively the two left and right shoes on which it is necessary to fix the pedal cleats, and a marking means 150.

The base 110 comprises a planar plate 112 serving as a seating for a foot and on which the gauge 120 can slide.

This also incorporates a planar plate 122 deeply hollowed out on one edge, with a scallop 124 thus leaving space for the foot when it rests on the baseplate 112. A stop 126, constituting the gauge 120, turned upwards, is disposed perpendicularly on the scalloped plate 112, at its most scalloped part, in order to come into contact with the heel of the foot at the end of the sliding gauge 120. Said plate 122 supporting the gauge 120 can slide between two runners 114 fixed laterally to the baseplate 112.

Each support 130 for a shoe is fixed to the sliding plate 122 supporting the gauge 120. It is intended to position the shoe correctly, with its sole turned upwards so that its counter, that is to say its rear part or heel grip, situated between its two quarters can be positioned at the same level as the heel of the foot.

Each support 130 thus comprises a sphere 132 fixed to a spindle 134 secured to the sliding plate 122, while being turned upwards, in order to secure the shoe longitudinally with respect to the stop 126. The counter of the shoe can be put in contact on the sphere 132 with precision.

It is interesting to remark that a plate coplanar with the support face of the stop 126 is tangent to the two spheres 132 in order to make the theoretical position of the calcaneum of the foot correspond to the inside of the shoe.

The spindle 134 passes through the sphere 132 and is extended by an end piece 136 forming a stop for the descent of the shoe in a turned-over position when the counter of the shoe covers the sphere 132.

The shoe C, held on the apparatus 100 in its turned-over position, is presented in FIG. 2 in broken lines. Its sole 6 is thus turned upwards.

In FIG. 1, a rod 138 forming a kind of shoetree is fixed to the spindle 134, under the sphere 132, in order to receive the front part of the instep of the shoe so that overall its sole can be positioned parallel to the baseplate 112. A rectilinear part of the rod passes through the spindle 134, with the option of adjusting its position so that the support 130 can hold the shoes in a large range of sizes, and in particular from 35 to 52. The locking of this rectilinear part in position is obtained by a clamping screw, preferably knurled, screwed through the spindle 134. The rectilinear part is extended by a rising oblique part, then by another portion that is vertical and is extended perpendicularly and horizontally by an end part that can support the shoe at its interior lining.

A support means, such as a magnet cooperating with a metal part embedded in the sphere, makes it possible to press the shoe on its support 130 correctly and with reproducible precision. A finger mounted for sliding on the free end of the rod 138 is also suitable for pressing the counter of the shoe on the sphere 132 with reproducible precision.

A flap 116 extends upwards on at least one edge of the baseplate 112 and in an almost vertical direction. It is used for orienting the shoe laterally so that the cleat that it is to receive can be fixed so that the shoe can be mounted parallel to the cranks of the cycle. The flap 116 is fixed, in FIG. 1, by two rods held on each runner.

The laterality of the shoes must be respected, that is to say it is necessary to place the left shoe on the left part of the apparatus 100 and the right shoe on the right part of the apparatus placed in its normal position of use, so that the internal edge of the shoes, disposed to the outside, can be put in contact with the corresponding flaps 116. This is because the internal edge of the shoe is the reference frame with respect to the cycle crank.

With the same intention of adapting the support 130 to various sizes of shoe and more precisely their width, the position of the spindle 134 may be modified laterally, that is to say with respect to the flap 116. Two grooves are thus produced, one transversely through the scalloped plate 122 in order to allow a lateral movement of the sphere 132 so that it is held on the middle part of the heel grip of the shoe, and the other longitudinally through the baseplate 112 in order to move the gauge 120 forwards or backwards. A gripping handle Ms, visible in FIG. 2, screwed onto a thread extending the spindle 134, makes it possible to release and clamp the sphere 132 in the chosen position and to lock said gauge 120 in position.

The position of the cleat that is to be fixed to the shoe with respect to the pedal is in principle determined with respect to the metatarsophalangeal joint of the big toe, which must be vertically in line with the axis of the pedal, considering the foot positioned horizontally on said pedal. The apparatus 100 of the invention thus has, in FIG. 1, a wall 140 that obliquely and upwardly extends the edge of the baseplate 112 that is opposite to the stop 126. It makes it possible to wedge the foot from the front, with the big toe in abutment on the inclined wall 140, on the baseplate 112 before moving the gauge 120 to put the stop 126 in contact with the heel, the calcaneum, of the foot of the cyclist. The oblique wall 140 forms with the baseplate 112 an obtuse angle of between 130° and 150°. In practice, the metatarsophalangeal joint of the big toe is positioned, by means of this wall 140, precisely vertical in line with the intersection of the baseplate 112 and the wall 140 for front wedging of the foot.

The position of the metatarsophalangeal joint of the big toe is thus perfectly defined on the baseplate 112.

This oblique wall 140 is extended at its top by a descending wall 142 that joins a third planar wall 144 forming the front support of the base 110 of the apparatus. On the other side of the apparatus 100, that is to say on the same side as the stop 126, its footing is raised by an intermediate wall 145 interposed between the other edge of the baseplate 112 and another wall 146 forming the rear support of the base 110 of the apparatus. The raising of the heel of the cyclist procured by this inclination makes use of the apparatus 100 more comfortable.

At this stage of the description of the invention, it will be understood that the position of a shoe can be correctly fixed on the apparatus with respect to the position of the metatarsophalangeal joint of the big toe of the corresponding foot. To show the ideal location for fixing the cleat on the shoe, the marking means 150 comprises a housing 152 incorporating a light projector 154 fixed on a footing 157 by means of a foot 156, said footing being mounted on the base 110 and precisely on its front wall 144. The light projector 154 comprises, in an advantageous construction mode, a laser diode capable of projecting a luminous line Lm, depicted in FIG. 2, onto the sole S of the shoe C on which it is necessary to place a pedal cleat. The luminous line appears transversely on the sole S of the shoe C.

The position of the foot 156 of the marking means 150 can be adjusted finely on the base 110 by means of the presence of a plate for fixing said foot and which has slots passing through it through which fixing screws clamp it. It is thus possible to compensate in particular for the measurement of the thickness of a liner.

In FIG. 1, the housing 152 is moreover mounted so as to pivot freely, preferably, in a plane perpendicular to the baseplate 112 of the foot of the cyclist and which is also parallel to a generatrix joining the centre of the two spheres 132.

It incorporates a location for housing cells/accumulators capable of supplying the laser diode with current. It also comprises a switch for switching on the laser diode.

The functioning of the adjustment apparatus 100 will now be explained. The apparatus 100 rests on the ground. The cyclist, preferably sitting on a chair, places one of his feet, for example the right foot, on the baseplate 112 and rests his other foot alongside the apparatus. He puts his big toe in abutment on a front wedging wall 140, and then an operator or he himself moves the gauge 120 in order to bring the stop 126 against his heel. He then clamps the gauge by means of the clamping handles Ms. He can consequently remove his foot, his measurement having been acquired. He fits the corresponding shoe C on the angled rod 138 of the right-hand support 130*b*, and then brings its counter into contact with the sphere 132, its internal edge being held in abutment on the lateral positioning flap 116.

It then suffices to power up the marking housing, and to tilt it, where applicable, in order to make a luminous line Lm appear on the sole S at the exact location for placing the pedal cleat. The latter is next fixed to the sole, for example by means of screws. The shoe provided with its cleat can be removed. The same procedure is followed for the other shoe.

The apparatus 100 of the invention easily and quickly effects the exact positioning of pedal cleats on cyclist shoes according to the morphology of the feet of the cyclist. The measurement of the positioning is precise.

In a variant embodiment presented in FIG. 3, the footing 157 of the marking means 150 is mounted for sliding, by means of a runner 160, on the base 110. The runner 160 is disposed transversely on the front support wall 144 of said base, enabling the marking means 150 to move from one lateral edge of the apparatus 100 to its other edge, that is to say between one or other of the shoes C present on the apparatus. The two arrows D1 and D2 indicate the two directions of movement of the marking means 150.

The apparatus 100 is provided with a means 170 for measuring the movement of the marking means 150, such as a graduated ruler 170 disposed along the runner 160, to measure the movement of the marking means 150. A reference P, present on the base 157, opposite the markings of the ruler 170, enables the amount of the movement of the marking means 150 to be read.

The light projector 154 of the marking means 150 is equipped with at least one laser diode capable of projecting two luminous lines, the one, described above under the reference Lm, which appears transversely on the sole S of the shoe C, and another luminous line Lm2 that is perpendicular to it. This other luminous line can thus be moved on the midplane of the shoe by moving the marking means 150. It is then possible to read, by means of the reference P, the distance d separating the internal edge of the wedged shoe on a corresponding lateral positioning flap 116, with its midplane, knowing that the zero value of the marking of the ruler 170 is fixed in the support plane of each lateral positioning flap 116. This measurement is advantageously used for adjusting a parameter of the cycle.

The invention claimed is:

1. An apparatus for effecting the positioning of cleats on cyclist shoes comprising:

a baseplate to which it is necessary to apply the arch of the foot, a gauge provided with a stop that can slide freely on said baseplate so as to be put in contact with the calcaneum of the foot, and a wall for wedging the front part of the foot, at the metatarsophalangeal joint of the big toe, wherein the stop is fixed on a plate mounted so as to slide parallel to the baseplate, and wherein at least one support for a shoe corresponding to the foot is fixed to said sliding plate, said support comprising a stop able to put into contact with the shoe counter, the apparatus being provided with a marker secured to the base of the apparatus and arranged so as to indicate, on the shoe sole, a location for placing the cleat.

2. The apparatus according to claim 1, wherein the stop for the shoe consists of a sphere.

3. The apparatus according to claim 2, wherein the sphere is arranged with a means for pressing the counter of the shoe against said sphere in order to position said shoe on its corresponding support with reproducible precision.

4. The apparatus according to claim 1, wherein the wedging wall is an oblique wall that extends the baseplate in an inclined manner and upwards, forming with said baseplate an obtuse angle of between 130° and 150°.

5. The apparatus according to claim 3, wherein the support is provided with a rod forming a kind of shoetree for the shoe in order to hold the shoe from inside, said rod being fixed to the sliding plate, so that the sole of said shoe can be positioned parallel to the baseplate.

6. The apparatus according to claim 5, wherein the rod comprises a rectilinear part that passes slidably through a spindle supporting the sphere.

7. The apparatus according to claim 5, wherein it comprises a flap that extends upwards on at least one edge of the baseplate in order to orient the shoe laterally so that the cleat that it is to receive can be fixed so that said shoe can be mounted parallel to the cycle cranks or taking account of particular podiatry data.

8. The apparatus according to claim 5, wherein it comprises two supports as well as two flaps, disposed on either side of the baseplate, and wherein the sliding plate is hollowed out with a scallop at a location where the foot is placed on the baseplate.

9. The apparatus according to claim 8, wherein the support face of the stop for the calcaneum is tangent to the two spheres in order to make the theoretical position of the calcaneum of the foot correspond to the inside of the shoe.

10. The apparatus according to claim 2, wherein two grooves are produced, one transversely through the sliding plate in order to allow a lateral movement of said or each sphere so that said or each sphere is held on the middle part of the heel grip of the shoe, and the other longitudinally through the baseplate in order to move the sliding plate forwards or backwards, a gripping handle screwed onto a thread extending the axis enabling releasing and locking said or each sphere in a chosen position and further locking said sliding plate in position.

11. The apparatus according to claim 1, wherein the marker comprises a housing incorporating a light projector, fixed by means of a bottom on the base of the apparatus.

12. The apparatus according to claim 11, wherein the light projector is mounted so as to pivot freely.

13. The apparatus according to claim 11, wherein the light projector incorporates a laser diode capable of projecting at least one luminous line on the sole of said shoe.

14. The apparatus according to claim 11, wherein the foot of the marker is provided with an adjuster for adjusting its position on the base.

15. The apparatus according to claim 14, wherein the foot of the base is fixed to a footing that is mounted for sliding, thanks to a runner, on said base, between the two supports, and in wherein the apparatus is provided with a sensor for measuring the movement of the marker.

* * * * *